US005159910A

United States Patent [19]

Ninomiya et al.

[11] Patent Number: 5,159,910

[45] Date of Patent: Nov. 3, 1992

[54] LUBRICATING APPARATUS FOR INTERNAL COMBUSTION ENGINE

[75] Inventors: Masakazu Ninomiya; Norio Omori, both of Kariya; Satoshi Nakagawa, Toyota, all of Japan

[73] Assignees: Nippondenso Co., Ltd., Kariya; Toyota Jidosha Kabushiki Kaisha, Toyota, both of Japan

[21] Appl. No.: 704,982

[22] Filed: May 24, 1991

[30] Foreign Application Priority Data

May 24, 1990 [JP] Japan ..... 2-134750

[51] Int. Cl.[5] ..... F01M 5/00

[52] U.S. Cl. ..... 123/196 AB; 123/196 S; 184/104.2

[58] Field of Search ..... 123/196 R, 196 S, 196 AB; 184/104.2

[56] References Cited

U.S. PATENT DOCUMENTS

| | | | |
|---|---|---|---|
| 2,228,460 | 1/1941 | Joy | 184/104.2 |
| 2,285,720 | 6/1942 | Joy | 184/104.2 |
| 4,112,910 | 9/1978 | Percy | 123/196 S |
| 4,168,693 | 9/1979 | Harrison | 123/196 S |
| 4,458,644 | 7/1984 | Papst | 123/196 S |
| 5,018,490 | 5/1991 | Kroner | 123/196 AB |

FOREIGN PATENT DOCUMENTS

| | | | |
|---|---|---|---|
| 53-67036 | 6/1978 | Japan | 184/104.2 |
| 53-114140 | 10/1978 | Japan . | |
| 60-65217 | 4/1985 | Japan | 184/104.2 |
| 60-222312 | 11/1985 | Japan . | |
| 63-105218 | 5/1988 | Japan . | |
| 63-195310 | 8/1988 | Japan . | |

*Primary Examiner*—E. Rollins Cross
*Assistant Examiner*—Erick Solis
*Attorney, Agent, or Firm*—Cushman, Darby & Cushman

[57] ABSTRACT

A lubricating apparatus for an internal-combustion engine comprises a detector for detecting whether the engine runs or not, a heat storage reservoir connected to lubricating oil outflow and inflow ports of the engine by a circular pipe system for storing the oil and maintaining its temperature, the heat storage reservoir being provided outside the engine, a hydraulic pump provided between the inflow port and the heat storage reservoir for controlling the supply of the oil stored in the heat storage reservoir to portions of the engine in response to a control signal, and a controller responsive to an output of the detector for producing the control signal to stop the hydraulic pump in order to maintain a temperature of the oil stored in the heat storage reservoir when the detector detects a stop of the engine and for producing the control signal to actuate the hydraulic pump to supply the oil, whose temperature is maintained by the heat storage reservoir, to the portions of the engine. The restarting of the engine is easily made because the oil is collected in the heat storage reservoir when the engine is stopped. In addition, the size of the engine is decreased, because the oil pan is omitted or part of the oil pan remains in the engine.

11 Claims, 5 Drawing Sheets

LUBRICATING APPARATUS FOR INTERNAL COMBUSTION ENGINE

BACKGROUND OF THE INVENTION

1. Field of the Invention

Field of the Invention

This invention relates to a lubricating apparatus for an internal combustion engine, and particularly to a lubricating apparatus for an internal combustion engine comprising a heat storage reservoir of lubricating oil.

2. Description of the Prior Art

A lubricating apparatus for an internal combustion engine is disclosed in Japanese patent application provisional publication No. 63-105218 which supplies lubricating oil, stored in an oil pan provided in the internal engine, to moving parts by a hydraulic pump. A heat accumulating material is heated to store heat energy by the lubricating oil of a high temperature during running of the engine. At restart of the engine, the heat energy stored in the heat accumulating material is supplied to the lubricating oil to increase a temperature of the lubricating oil in order to make starting of engine readily.

However, in the prior art lubricating apparatus, there is a drawback that the size of the engine is large because the oil pan is provided in the engine. In addition another drawback is that the temperature of the lubricating oil does not increase sufficiently at restart because the heat accumulating material should heat the lubricating oil which has been cooled, so that starting the engine is not sufficiently improved.

SUMMARY OF THE INVENTION

The present invention has been developed in order to remove the above-described drawbacks inherent in the conventional lubricating apparatus for an internal combustion engine.

According to the present invention there is provided a lubricating apparatus for an internal-combustion engine, comprising: a detector for detecting whether the engine runs or not; a heat storage reservoir connected to outflow and inflow ports of lubricating oil of the engine by a circular pipe system for storing the lubricating oil and maintaining its temperature, the heat storage reservoir being provided outside the engine; a hydraulic pump, driven by a motor, provided between the inflow port and the heat storage reservoir for controlling the supply the lubricating oil stored in the heat storage reservoir to portions of the engine in response to a control signal; and a controller responsive to an output of the detector for producing the control signal to stop the hydraulic pump in order to maintain a temperature of the lubricating oil stored in the heat storage reservoir when the detector detects a stop of the engine and for producing the control signal to actuate the hydraulic pump to supply the lubricating oil, whose temperature is maintained by the heat storage reservoir, to the portions of the engine. Restart of the engine is made easy because the lubricating oil is collected in the heat storage reservoir during the stopping of the engine. The size of the engine is decreased because the oil pan is omitted.

According to the present invention there is also provided a second lubricating apparatus for an internal-combustion engine, comprising: a detector for detecting whether the engine runs or not; a heat storage reservoir connected to outflow and inflow ports of lubricating oil of the engine by a circular pipe system for storing the lubricating oil and maintaining its temperature, the heat storage reservoir being provided outside the engine; an oil pan provided in the crank room of the engine for storing the lubrication oil; a hydraulic pump, provided between the oil pan and the inflow port, driven by the engine for controlling the supply of the lubricating oil stored in the heat storage reservoir to portions of the engine requiring lubrication through the inflow port and the pipe system in response to rotation of the engine; a cut-off valve responsive to a drive signal provided between the outflow port and the heat storage reservoir for controlling a flow of the lubricating oil into the heat storage reservoir in response to a control signal; and a controller responsive to the output of the detector for producing the control signal so as to stop the flow when a given interval has passed after detecting a stop of the engine from the output and for producing the control signal so as to produce the flow when running of the engine is detected by the output. The capacity of the heat storage reservoir for storing the lubricating oil is smaller than that of the heat storage reservoir in the second lubricating apparatus.

BRIEF DESCRIPTION OF THE DRAWINGS

The object and features of the present invention will become more readily apparent from the following detailed description taken in conjunction with the accompanying drawings in which.

The same or corresponding elements or parts are designated as like references throughout the drawings.

DETAILED DESCRIPTION OF THE INVENTION

Hereinbelow will be described a first embodiment of of this invention with reference to the drawings.

Figure 1:
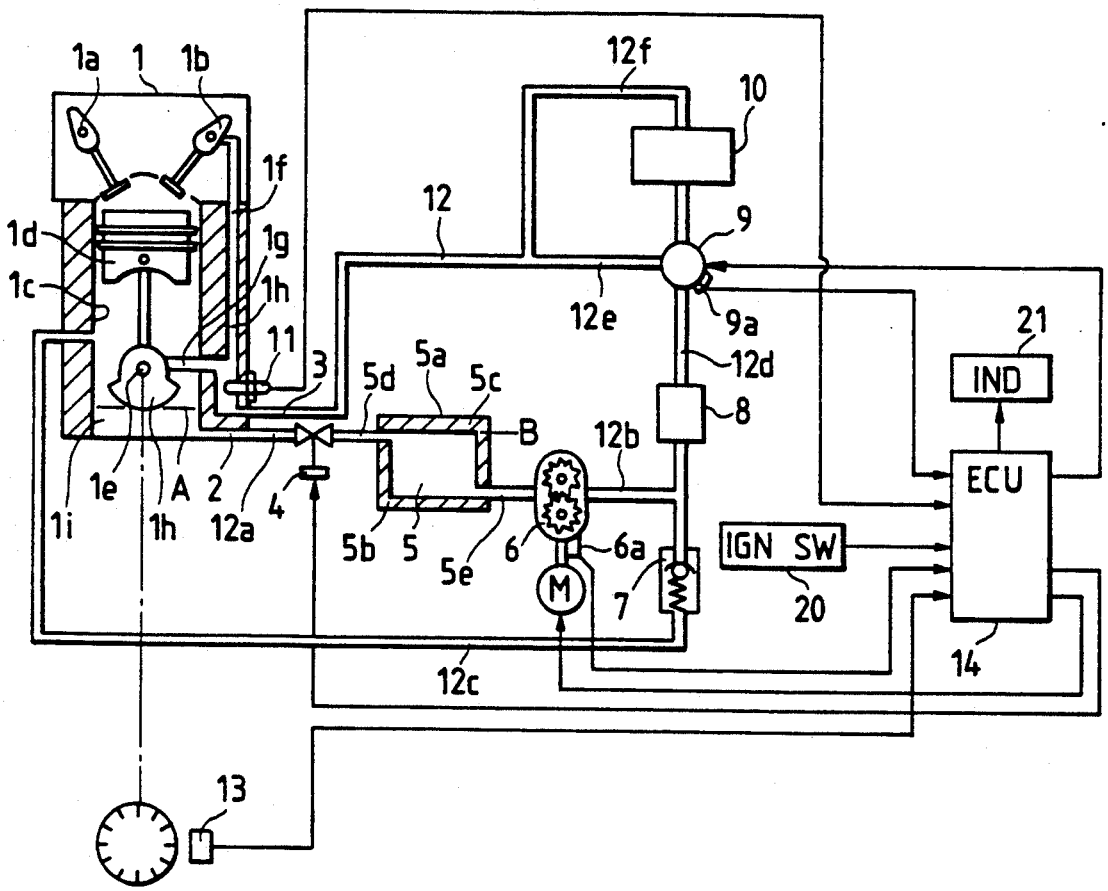
FIG. 1 is a block diagram of a first embodiment of a lubricating apparatus.

FIG. 1 is a block diagram of the first embodiment of a lubricating apparatus. In FIG. 1, an internal combustion engine 1 comprises a cam shaft 1*a* of an intake valve and a cam shaft 1*b* of an exhaust valve, a cylinder 1*c*, a piston 1*d* which reciprocates due to explosion, a crank shaft 1*e* for converting reciprocation of the piston 1*d* into rotating movement, a balance weight 1*h* connected to the crank shaft 1*e*, and a lubricating apparatus 12. The lubricating apparatus comprises a circular pipe system including pipes 12*a*, 12*b*, 12*c*, 12*d*, 12*e*, and 12*f*. Lubricating oil in the engine 1 flows out through an outflow port 2 to the pipe 12*a*. A heat storage reservoir 5 stores the lubricating oil from the outflow port 2 with its temperature maintained. The heat storage reservoir 5 is provided outside the engine 1, instead of the conventional oil pan included in the conventional engine 1. The heat storage reservoir 5 comprises an outside case 5*a*, an inside case 5*b*, and a heat insulating material 5*c* provided between the outside and inside cases 5*a* and 5*b* for maintaining a temperature of the lubricating oil by reducing heat radiation. The lubricating oil flows through the outflow port 2 through the pipe 12*a* and enters the heat storage reservoir 5 through an inflow port 5*d* provided to the upper end portion of the head storage reservoir 5. The lubricating oil stored in the heat storage reservoir 5 flows out through an outflow port 5*e*. A hydraulic (oil) pump 6 driven by a motor M provided down stream from the outflow port 5*e* supplies the lubricating oil with a pressure. A pump sensor 6*a* detects whether the hydraulic pump 6 is running or stopping. A cut-off valve 4 is provided upstream from the outflow port 5*d* for cutting off the flow of the lubricating oil at the inflow port 5*d*. A relief valve 7 is provided at one end of a T-shaped pipe 12*b*, which reduces the hydraulic pressure of the lubricating oil by releasing a portion of the lubricating oil to the inside of the engine through pipe 12*c* connecting the relief valve to the engine when the hydraulic pressure of the lubricating oil is larger than a given value when supplying the lubricating oil. An oil filter 8 is provided to another end of the T-shaped pipe 12*b*, for removing dirt of the lubricating oil. The oil filter 8 is connected to an inflow port 1 of the engine 3 through a switch valve 9. The lubricating oil returns to the engine through the inflow port 3 and is supplied to each portion of the engine 1 through oil passages 1*g* and 1*f*. A temperature sensor 11 is provided in the oil passage 1*h* near the inflow port 3. The switch valve 9 switches the flow of the lubricating oil toward an oil cooler 10 when the temperature sensor 11 detects that the temperature of the lubricating oil exceeds a given value. A valve position sensor 9*a* provided at the switch valve 9 detects a position of the switch valve 9. The oil cooler 10 cools the lubricating oil flowing thereinto when the switch valve 9 is switched to a cooling position. A pipe 12*f* extending from the oil cooler 10 is connected to an end of the pipe 12*e* to supply the lubricating oil to the engine. A rotational speed of the engine 1 is detected by a rotational speed sensor 13 whose shaft is connected to the crank shaft 1*e*. An electronic control unit (ECU) 14 controls the cut-off valve 4, the switch valve 9, the motor M, and an indicator 21 in response to outputs of the temperature sensor 11, the rotational speed sensor 13, the valve position sensor 9*a*, the pump sensor 6*a*, and an ignition key.

A level "A" denotes a lowest position of the balance weight 1*h* when the balance weight positions at a lowest rotational position, and a level "B" denotes a highest possible level of the lubricating oil in the heat storage reservoir 5. The level "B" is lower than the level "A". Therefore, this arrangement prevents loss of the engine which would be developed by stirring up the lubricating oil collected in the lower portion 1*i* of the crank room due to rotation of the crank shaft 1*e*.

Figure 7:
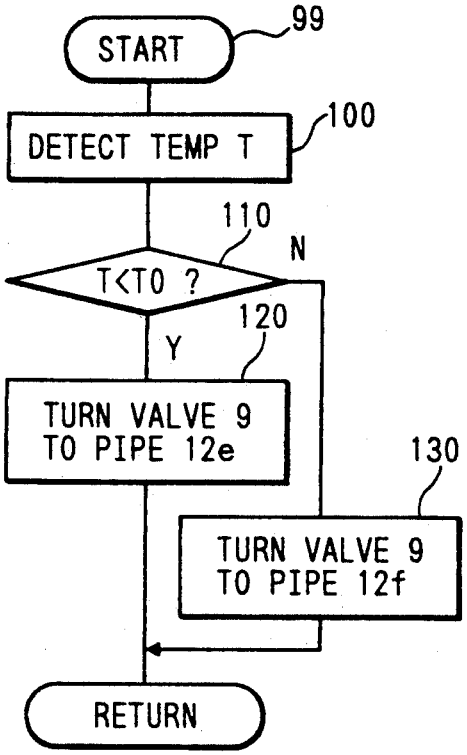
FIGS. 7, 8 and 9 show flow charts of the first embodiment.

Hereinbelow will be described operation of the lubricating apparatus with reference to flow charts of FIGS. 7, 8 and 9.

During normal running of the engine 1, the lubricating oil stored in the heat storage reservoir 5 is heated to a high temperature by combustion. The lubricating oil flows out from the heat storage reservoir 5 through the outflow port 5*e* and to the T-shaped pipe 12*b* by the hydraulic pump 6 with a hydraulic pressure. When a pressure P of the lubricating oil is larger than a reference pressure P0, the pressure is reduced by releasing a portion of the lubricating oil to the cylinder 1*c* through pipe 12*c* by the relief valve 7. When a pressure P of the lubricating oil is equal to or smaller than a reference pressure P0, the relief valve 7 is closed so that the lubricating oil flows to the switch valve 9 through the oil filter 8. The ECU 14 detects the temperature of the lubricating oil by the temperature sensor 11 at step 100 shown in FIG. 7. In the following step 110, the ECU 14 compares the detected temperature T with a given temperature T0, for example 100° C. If the temperature T is lower than the given temperature T0, processing proceeds to step 120 where the ECU 14 switches over the switch valve 9 to allow the lubricating oil flow to the pipe 12*e*. Thus, the lubricating oil of a high temperature passing through the oil filter 8 is sent to the inflow port 3 through the pipe 12*e* and is supplied to the cam shaft 1*a* of the intake valve, the cam shaft 1*b* of the exhaust valve, cylinder 1*c*, the crank shaft 1*e*, etc. through oil passages 1*f* and 1*g* extending to each portion of the engine 1. If the temperature T is not lower than the given temperature T0, processing proceeds to step 130 where the ECU 14 switches over the switch valve 9 to allow the lubricating oil flow to the pipe 12*f*. Thus, the lubricating oil of a high temperature is cooled by the oil cooler 10 by passing therethrough, and cooled lubricating oil is sent to each portion of the engine 1 through the pipe 12*f* to each portion of the engine 1.

Figure 8:
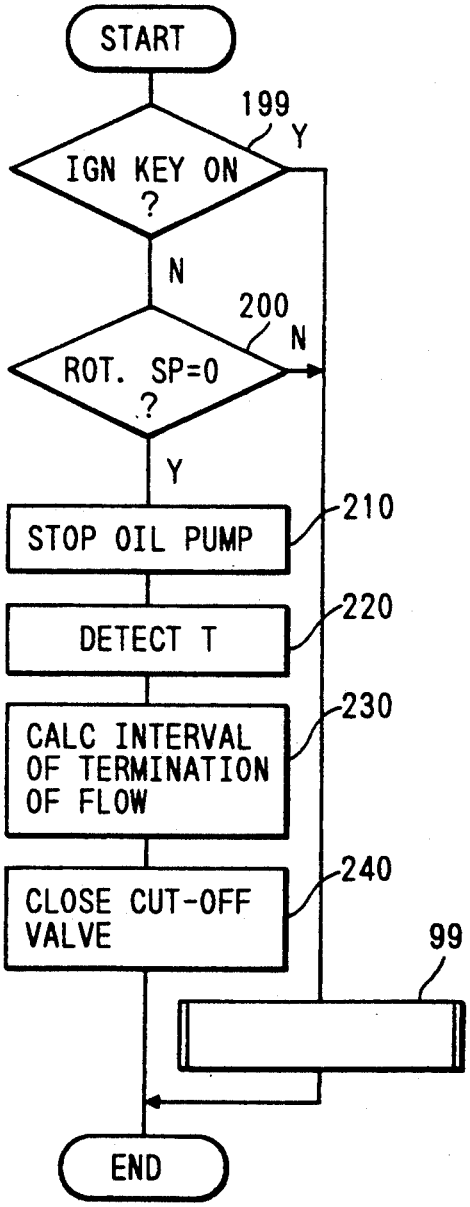
Figure 9:
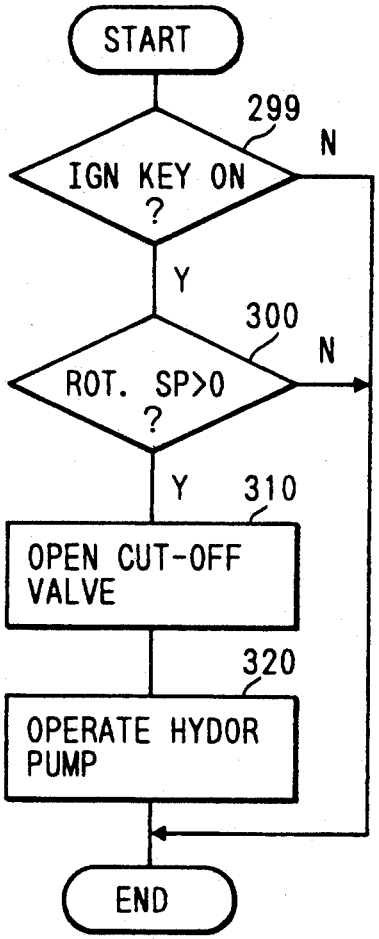

The operation of the ECU 14 when the engine 1 stops is shown in FIG. 8. In step 199, the ECU 14 detects whether the ignition key is ON or OFF. If NO, processing proceeds to step 200. If ON, processing proceeds to a subroutine 99 described above. In step 200, the ECU 14 makes a decision as to whether the rotational speed of the engine 1 is zero or not, i.e. whether or not the engine 1 has stopped. If the engine 1 stops, processing proceeds to step 210 where the ECU 14 stops the hydraulic pump 6. In the following step 220, the ECU 14 detects the temperature of the lubricating oil. Then, processing proceeds to step 230.

Figure 2:
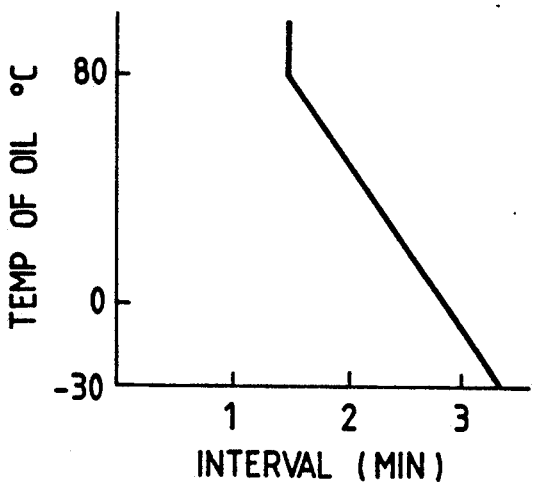
FIG. 2 shows a relation between the temperature of the lubricating oil and the interval necessary for terminating the collecting of the lubricating oil into the heat storage reservoir.

When the engine 1 stops, the lubricating oil existing in the cylinder 1*c* and the circular pipe system 12 flows into the heat storage reservoir 5 through the outflow port 2 via pipe 12*a*. An interval necessary for terminating the collecting of the lubricating oil in the heat storage reservoir 5 varies with viscosity of the lubricating oil and is determined by the temperature of the lubricating oil. FIG. 2 shows a relation between the temperature of the lubricating oil and the interval necessary for terminating the collecting of the lubricating oil into the heat storage reservoir 5. In step 230, the ECU 14 calculates the interval necessary for collecting the lubricating oil by using a map or a table which indicates a relation between the temperature of the lubricating oil and the interval necessary for terminating the collecting of the lubricating oil into the heat storage reservoir 5. In the following step 240, the ECU closes the cut-off valve 4 when the interval calculated in step 240 has passed. This closes the inflow port 5*d* of the heat storage reservoir 5 so as to increase an efficiency of maintaining the temperature of the lubricating oil.

The operation of restarting the engine 1 will be described with reference to FIG. 9.

In step 299, the ECU 14 makes a decision as to whether or not the ignition key 20 is ON. If YES, processing proceeds to step 300. If NO, this processing ends. In step 300, the ECU 14 makes a decision as to whether or not the rotational speed of the engine 1 is larger than zero. If the rotational speed is larger than zero, processing proceeds to step 310 where the ECU 14 opens the cut-off valve 4. In the following step 320, the ECU 14 starts the hydraulic pump 6 and ends this operation. If an interval from the stop of the engine 1 to restart of the engine 1 is shorter than a given interval, the temperature of the lubricating oil is higher than the ambient temperature. The temperature of the lubricating oil after twelve hours has passed is about 50° C., for example. This high temperature lubricating oil is supplied by the hydraulic pump 6 with a pressure to each portion of the engine 1 through inflow port 3. Friction of each portion of the engine 1 is reduced by the high temperature lubricating oil, i.e., the lubricating oil has a low viscosity, so this makes starting the engine easy and rate of fuel consumption is improved.

In the above mentioned embodiment, operation of the engine 1 is detected by the ignition key 20 and rotational speed sensor 13. However, there are various ways to detect that the engine 1 is running. For example, a detection signal of operation of a starter of the engine 1 (not shown) can be used to detect the operation of the engine 1. Further, the rotational speed of the engine 1 is detected periodically and two succeeding values are compared to detect the operation of the engine 1.

Figure 5:
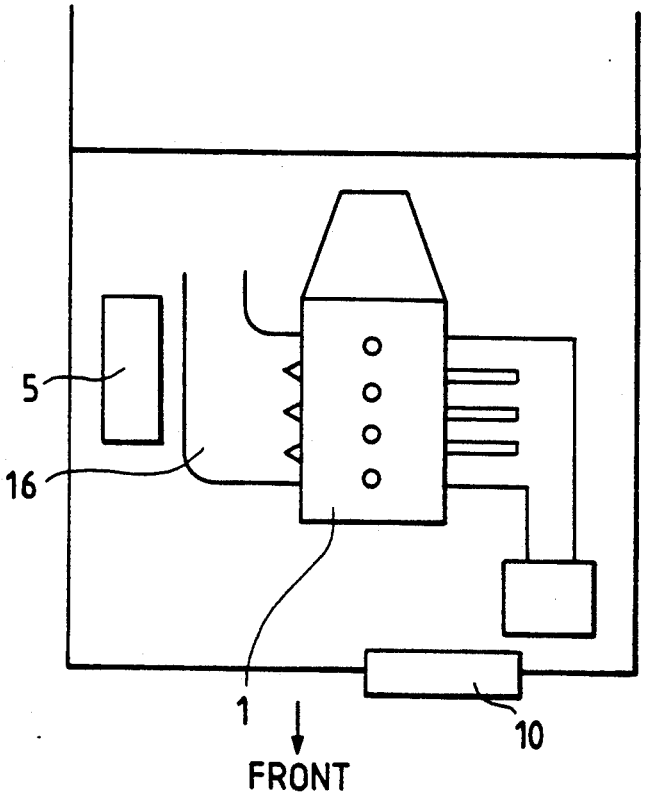
FIG. 5 is a plan view of an engine room of a motor vehicle where the lubricating apparatus is provided.

FIG. 5 is a plan view of an engine room of a motor vehicle where the lubricating apparatus is provided. In FIG. 5, the heat storage reservoir 5 is arranged near an exhaust manifold 16 to utilize exhaust heat to increase thermal insulation efficiency. On the other hand, the oil cooler 10 is arranged apart from the exhaust manifold 16 to reduce the affect of the exhaust heat.

Figure 6:
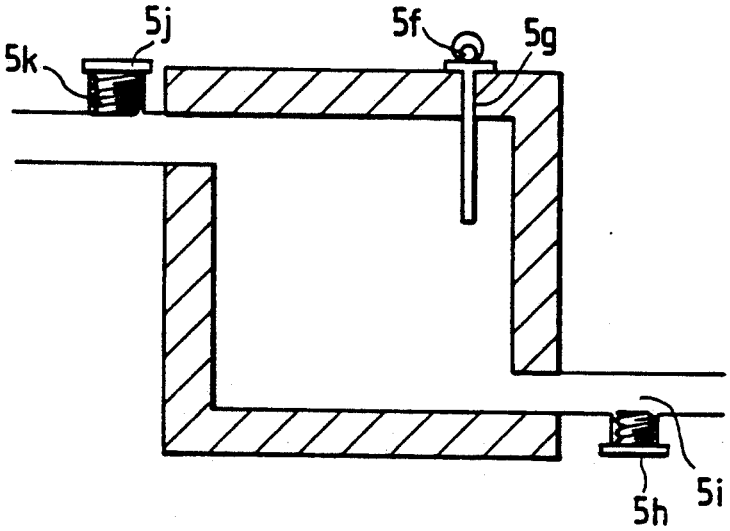
FIG. 6 is a cross-sectional view of the heat storage reservoir.

FIG. 6 is a cross-sectional view of the heat storage reservoir 5. An oil level gage **5*f* for checking oil level and a holding hole 5*g* for holding the oil level gage 5*f* may be provided. Further, there are provided, as required, a drain hole 51 and a drain screw 5*j* for closing the drain hole 5*i*, an oil refill hole 5*k* and a refill screw for closing the refill hole 5*k***.

Figure 3:
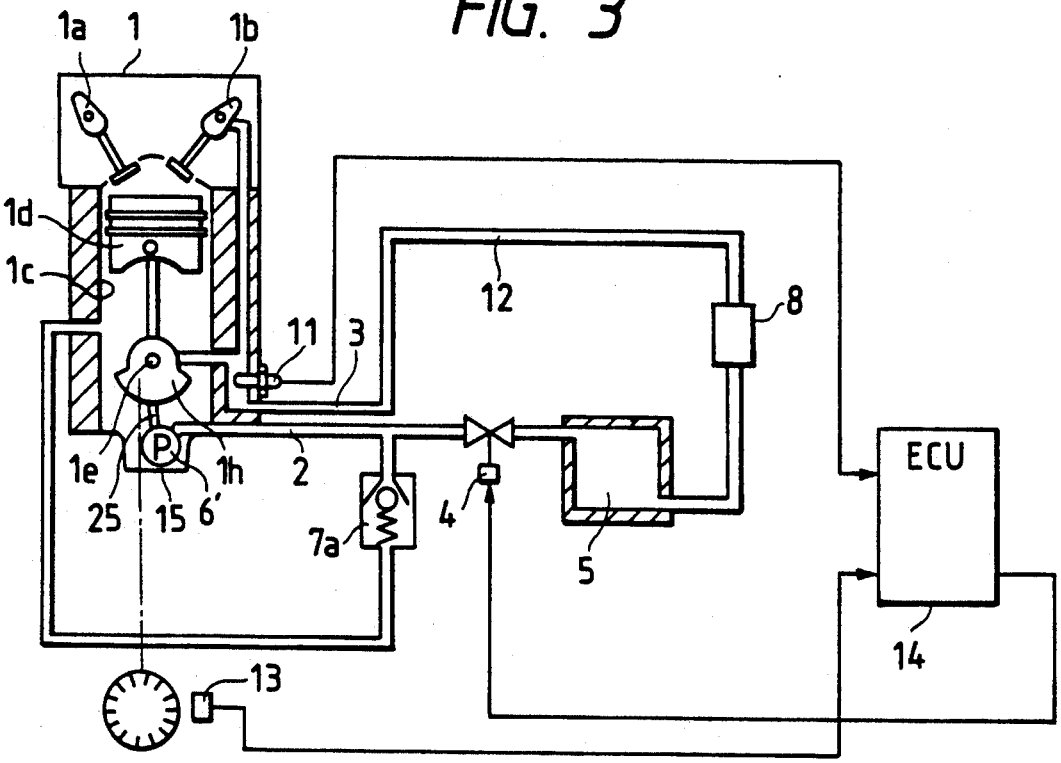
FIG. 3 is a block diagram of a modified embodiment of the first embodiment.

FIG. 3 is a block diagram of a modified embodiment of the first embodiment. A portion of the oil pan can be left in the engine room as shown in FIG. 3. For example, if the total amount of the lubricating oil is four liters, one liter of the lubricating oil is stored in the oil pan 15 and the remainder is stored in the heat storage reservoir 5. The oil pump 6' is provided in the oil pan 15 driven by an output power of the engine 1 through a coupling mechanism 25. The oil pump 6' supplies the lubricating oil to each portion of the engine through the circular pipe system 12. All other operations are the same as that of the lubricating apparatus shown in FIG. 1. Moreover, a viscosity sensor for detecting the viscosity of the lubricating oil can be used, instead of the temperature sensor 11, to determine the instance that the cut-off valve 4 should be closed.

Figure 4:
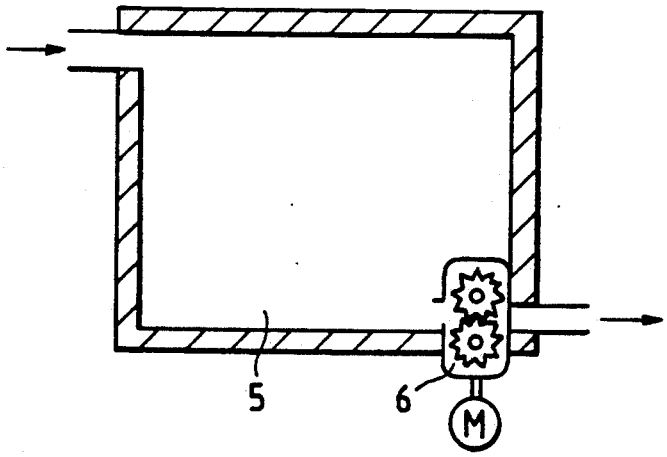
FIG. 4 is a cross-sectional view of the heat storage reservoir of another modified embodiment of the first embodiment.

FIG. 4 is a cross-sectional view of the heat storage reservoir of another modified embodiment of the first embodiment. In FIG. 4, the hydraulic pump 6 can be provided in the heat storage reservoir 5. Heat insulation can be improved by evacuation of the space between the outside case **5*a* and the inside case 5*b* without the heat insulation material 5*c***.

Figure 10:
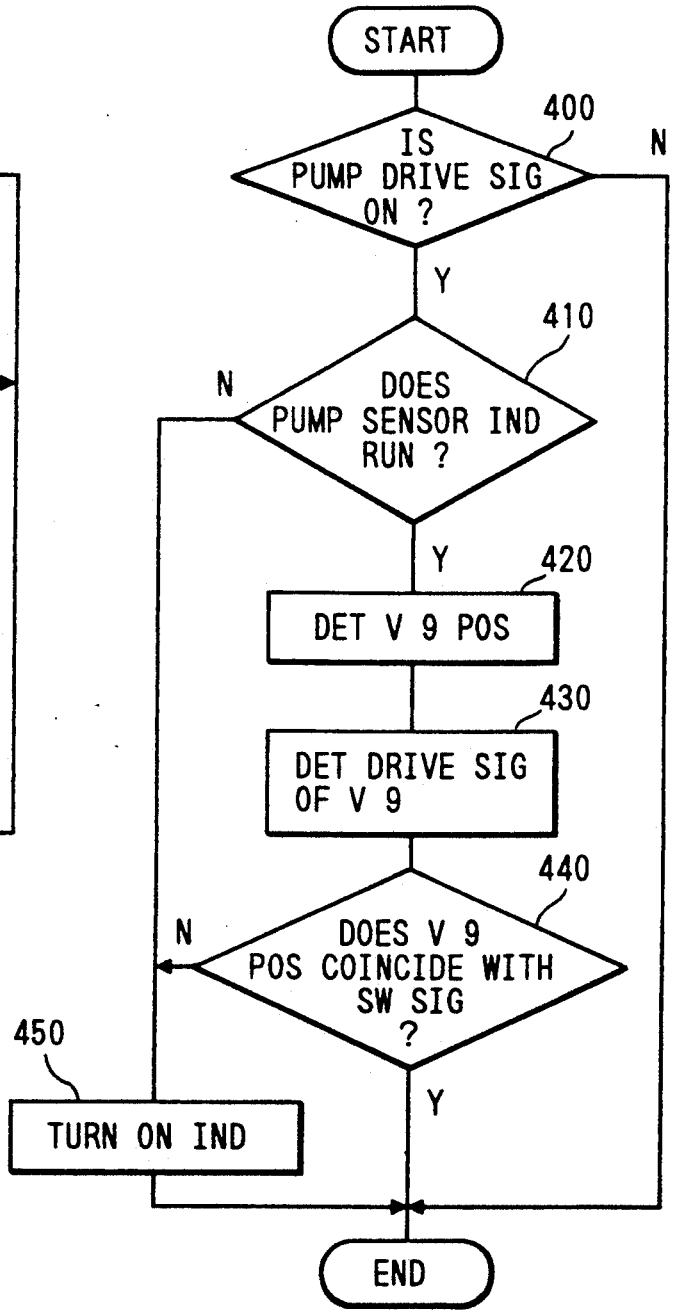
FIG. 10 shows a flow chart of a second embodiment.

Hereinbelow will be described a second embodiment of the invention of the lubricating apparatus. Basic structure is the same as that of the first embodiment shown in FIG. 1. However, a pump sensor **6*a* for detecting operation of the hydraulic pump 6 and a valve position sensor 9*a* for detecting the position of the switch valve 9 are additionally used to detect a trouble in the lubricating apparatus. FIG. 10** shows a flow chart of the second embodiment.

This processing is executed at every given interval by the ECU 14. In the first step 400, the ECU 14 makes a decision as to whether a drive signal of the hydraulic pump 6 is outputted or not. If YES, processing proceeds to step 410 where the ECU 14 detects whether the hydraulic pump 6 is running or not by checking an output of the pump sensor **6*a*. If YES, processing proceeds to step 420. In step 420, the ECU 14 detects the position of the switch valve 9 from an output of the pump sensor 9*a*, i.e., it detects which pipe 12*e* or 12*f*, is communicated by the switch valve 9. In the following step 430, the ECU 14 detects whether or not a drive signal of the switch valve 9 is outputted, i.e., it checks that the drive signal of the switch valve 9 indicates which pipe 12*e* or 12*f* should be communicated by the switch valve 9. In the succeeding step 440, the ECU 14 detects that the drive signal of the switch valve 9 coincides with the output of the switch valve position sensor detected in step 420. If YES the ECU 14 determines that the switch valve 9 is normally operated. In step 410, if the answer is NO, i.e., the output of the pump sensor 6*a* is of stop operation, the ECU 14 determines that the hydraulic pump 6 gets out of order in step 450, where it warns the driver of the trouble by turning on the indicator 21. In step 440, if the ansewer is NO, i.e., the drive signal of the switch valve 9 does not coincide with the output of the valve position sensor 9*a* detected in step 420, the ECU 14 determines that there is trouble in step 450**, where it warns the driver of the trouble by turning on an indicator.

As mentioned above, the lubricating apparatus of the second embodiment detects trouble in the hydraulic pump 6 and the switch valve 9.

This invention provides minaturization of the engine because the conventional oil pan is omitted by the heat storage reservoir 5 for storing the lubricating oil outside the engine 1. The stability when running the motor vehicle is improved because the engine 1, having the lubricating apparatus of the invention, can be mounted on the motor vehicle at a lower position than the height of the conventional oil pan. Moreover, when restarting the engine, the hydraulic pump 6 supplies the lubricating oil, whose temperature is maintained, to the engine, so that starting of the engine is easily made and fuel consumption is improved.

What is claimed is:

1. A lubricating apparatus for an internal-combustion engine, comprising:

detection means for detecting whether or not said engine is on;

a heat storage reservoir for storing lubricating oil and maintaining its temperature, said lubricating oil passing through an outflow port and an inflow port of said engine, said heat storage reservoir being connected to said outflow and inflow ports by a circular pipe system, said heat storage reservoir being provided outside of said engine;

a hydraulic pump, driven by a motor, provided between said inflow port and said heat storage reservoir, for controlling supply of said lubricating oil stored in said heat storage reservoir to portions of said engine requiring lubrication through said inflow port and said circular pipe system based upon a control signal;

first control means for producing said control signal to stop said hydraulic pump in order to maintain a temperature of said lubricating oil stored in said heat storage reservoir, based upon said detection means detecting that said engine has stopped, and for producing said control signal to cause said hydraulic pump to supply said lubricating oil, with its temperature maintained by said heat storage reservoir, to said portions of said engine;

cut-off means for controlling a flow of said lubricating oil into said heat storage reservoir according to a second control signal, said cut-off means being provided between said outflow port and said heat storage reservoir; and second control means for producing said second control signal to stop said flow when a predetermined time period has passed, based upon said detection means detecting that said engine has stopped, and for producing said second control signal to start said flow, based upon said detection means detecting that said engine is running.

2. A lubricating apparatus as claimed in claim 1, wherein a highest possible level of said lubricating oil in said heat storage reservoir is lower than a lowest end of a balance weight connected to a crank shaft of said engine when said balance weight is at its lowest rotational position.

3. A lubricating apparatus as claimed in claim 1, further comprising:

temperature detecting means for detecting a temperature of said lubricating oil; and third control means for determining said predetermined time period, based upon said temperature detection means, such that the higher the temperature of said lubricating oil, the shorter said predetermined time period.

4. A lubricating apparatus as claimed in claim 1, wherein said detection means comprises rotation detection means for detecting whether or not a part of said engine is rotating.

5. A lubricating apparatus as claimed in claim 1, wherein said heat storage reservoir is located near an exhaust manifold of said engine.

6. A lubricating apparatus for an internal-combustion engine, comprising:

detection means for detecting whether or not said engine is on;

a heat storage reservoir for storing lubricating oil and maintaining its temperature, said lubricating oil passing through an outflow port and an inflow port of said engine, said heat storage reservoir being connected to said outflow and inflow ports by a circular pipe system, said heat storage reservoir being provided outside of said engine;

an oil pan provided in a crank room of said engine for storing said lubrication oil;

a hydraulic pump, provided between said oil pan and said inflow port, driven by said engine, for controlling supply of said lubricating oil stored in said heat storage reservoir to portions of said engine requiring lubrication through said inflow port and said circular pipe system based upon a rotation of said engine;

a cut-off valve, provided between said outflow port and said heat storage reservoir, for controlling a flow of said lubricating oil into said heat storage reservoir according to a control signal; and control means for producing said control signal to stop said flow when a predetermined time period has passed after said detection means detects that said engine has stopped and for producing said control signal to start said flow when said detection means detects that said engine is running.

7. A lubricating apparatus as claimed in claim 6, wherein a capacity of said heat storage reservoir for storing said lubricating oil is smaller than that of said oil pan.

8. A lubricating apparatus as claimed in claim 6, wherein a highest positive level of said lubricating oil in said heat storage reservoir is lower than a lowest end of a balance weight connected to a crank shaft of said engine when said balance weight is at its lowest rotational position.

9. A lubricating apparatus as claimed in claim 6, further comprising:

temperature detection means for detecting a temperature of said lubricating oil; and second control means for determining said predetermined time period, based upon said temperature detection means, such that the higher the temperature of said lubricating oil, the shorter said predetermined time period.

10. A lubricating apparatus as claimed in claim 6, wherein said detection means comprises rotation means for detecting whether or not said engine is rotating.

11. A lubricating apparatus as claimed in claim 6, wherein said heat storage reservoir is located near an exhaust manifold of said engine.

* * * * *